US006883939B2

(12) United States Patent
Chen

(10) Patent No.: US 6,883,939 B2
(45) Date of Patent: Apr. 26, 2005

(54) DETACHABLE LAMPSHADE

(76) Inventor: Chaur-Bing Chen, No. 10, Alley 53, Lane 136, Shu-Te Rd., Wu-Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/674,596

(22) Filed: Sep. 30, 2003

(65) Prior Publication Data

US 2005/0068778 A1 Mar. 31, 2005

(51) Int. Cl.[7] ..... F21V 1/06; F21V 11/00

(52) U.S. Cl. ..... 362/352; 362/357; 362/358; 362/361; 362/450

(58) Field of Search ..... 362/352, 311, 351, 362/356, 355, 357, 358, 361, 450

(56) References Cited

U.S. PATENT DOCUMENTS 2,669,651 A * 2/1954 MacFadden ..... 362/355
2,752,482 A * 6/1956 Smith ..... 362/358
3,109,252 A * 11/1963 Schellenberg ..... 40/554

* cited by examiner

*Primary Examiner*—Stephen Husar
*Assistant Examiner*—Sharon Payne
(74) *Attorney, Agent, or Firm*—William E. Pelton, Esq.

(57) ABSTRACT

A detachable lampshade includes an upper ring and a lower ring parallel to each other. Multiple shades are made of a resilient material and are bent outside the upper ring and the lower ring. Each shade has two rods respectively provided at two sides thereof A plurality of tubes is provided between the upper ring and the lower ring. Each tube has a channel longitudinally defined through an outer periphery of the tube. An upper slot and a lower slot are transversally defined at a diametrically opposite side of the channel for respectively locating the upper ring and the lower ring. The adjacent rods are received in the respective tubes through the channels and positioned between the upper ring and the respective upper slots, and between the lower ring and the respective lower slots.

4 Claims, 4 Drawing Sheets

DETACHABLE LAMPSHADE

BACKGROUND OF THE INVENTION

1. Field of the Invention

The present invention is related to a lampshade, and more particularly to a detachable lamp that is easily stored or transported.

2. Description of Related Art

Conventional lampshades generally have fixed shapes and occupy large storage spaces and raise costs for transporting.

Therefore, the invention provides a detachable lampshade to mitigate or obviate the aforementioned problems.

SUMMARY OF THE INVENTION

The main objective of the invention is to provide a detachable lampshade to reduce its size for storage and cost for transporting.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
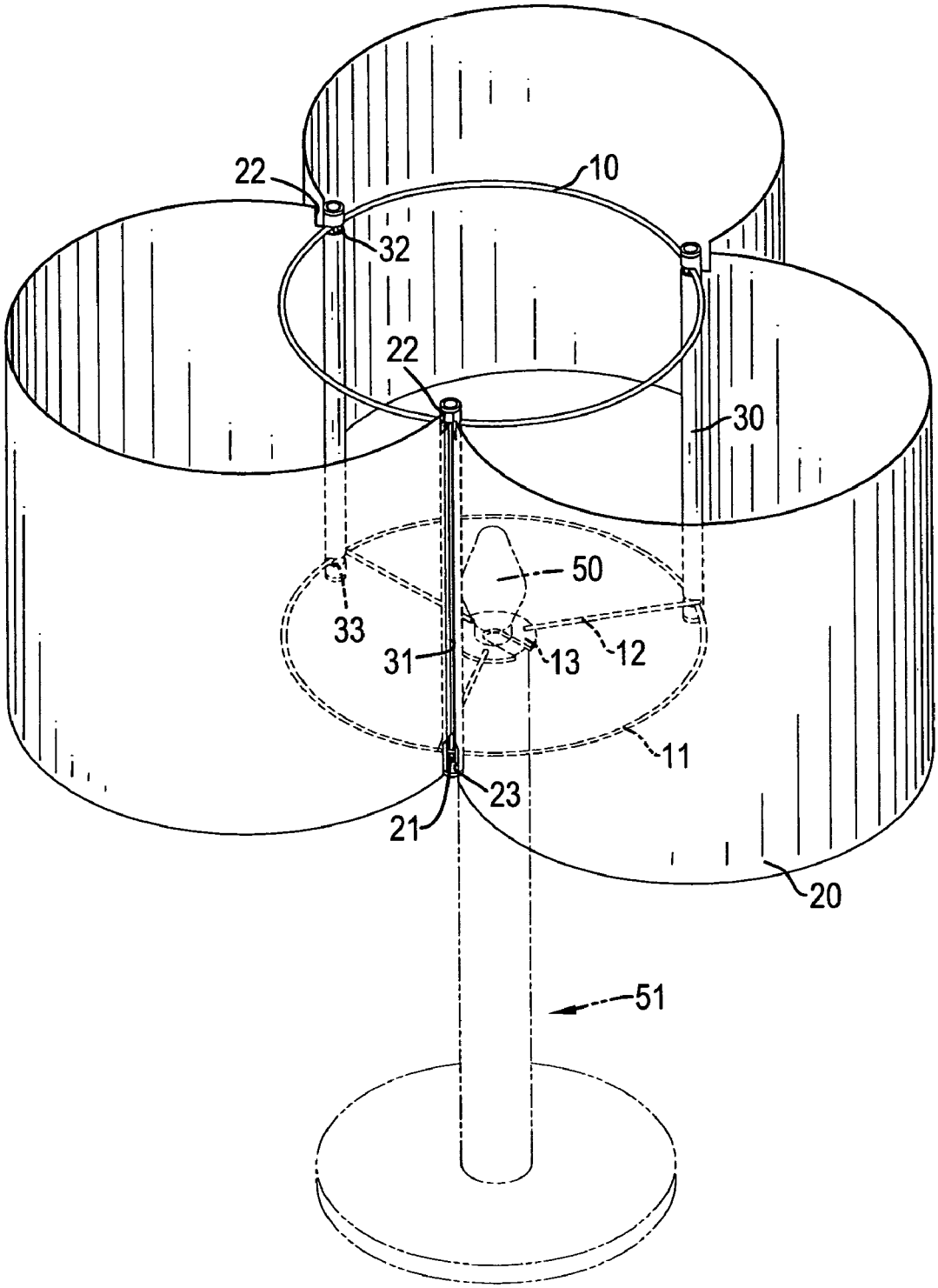
FIG. 1 is a perspective view of a lampshade in accordance with the invention.
Figure 2:
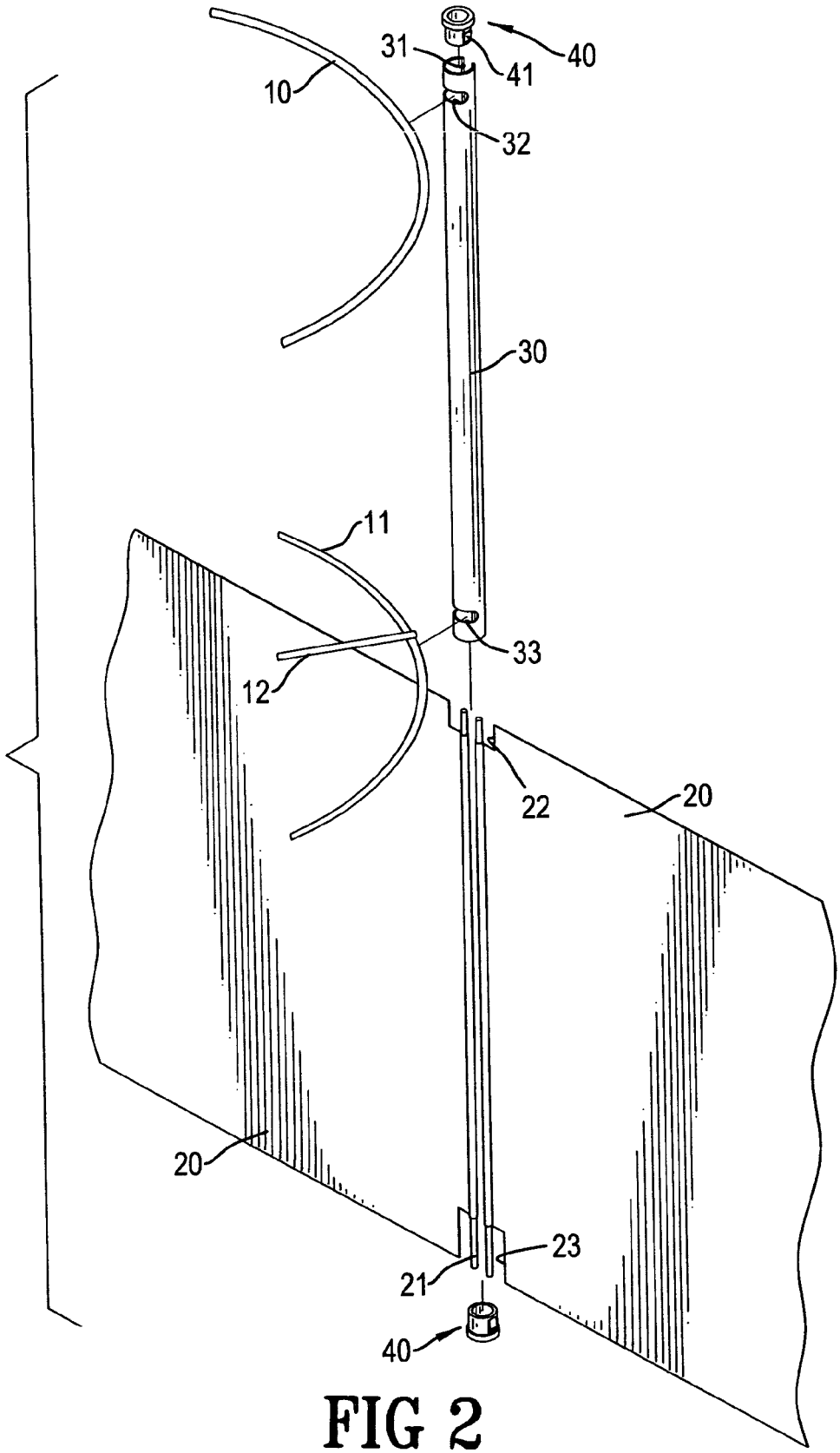
FIG. 2 is an enlarged exploded perspective view of a joint of the lampshade in FIG. 1.
Figure 3:
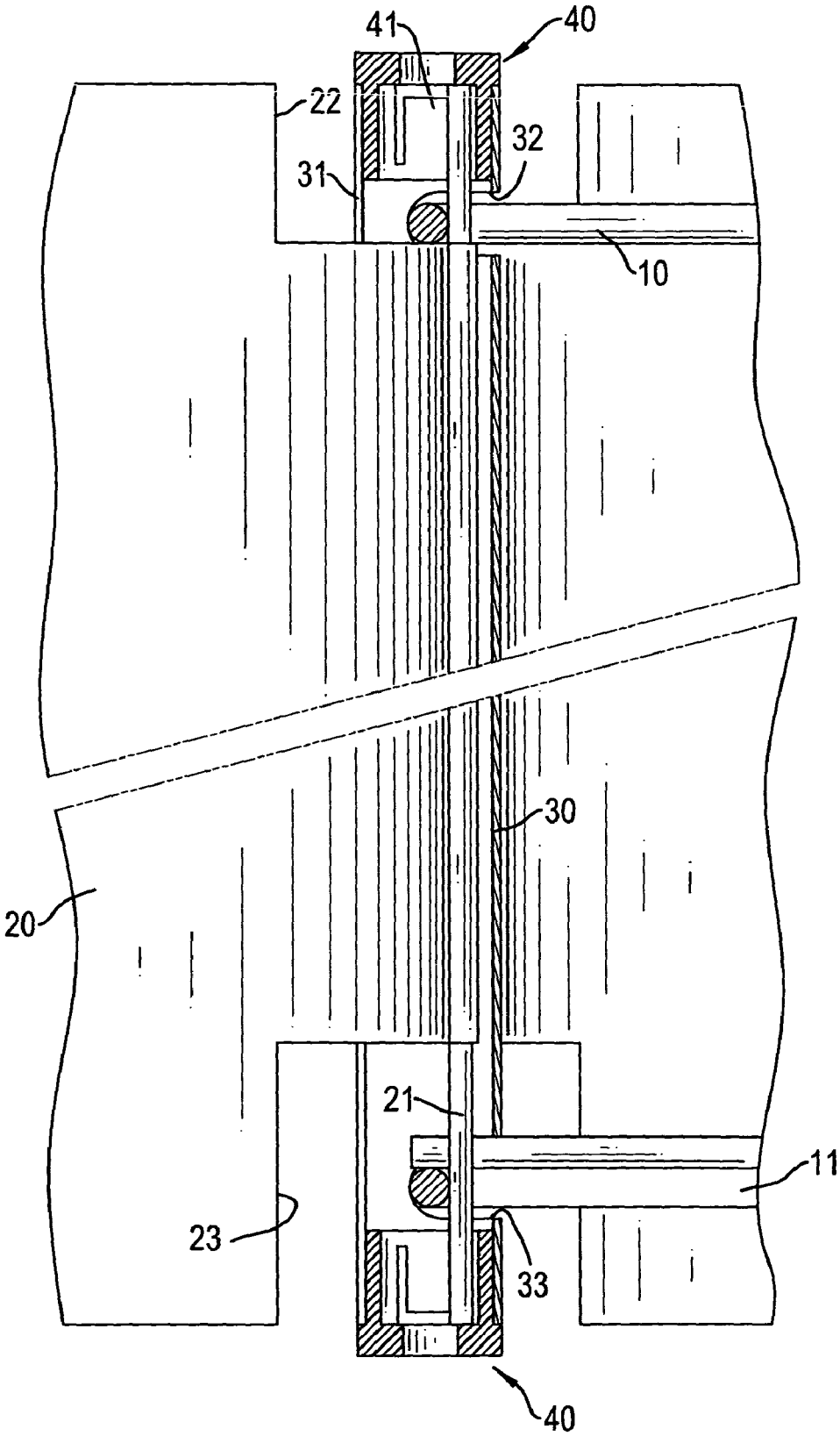
FIG. 3 is a side plan view in partial section of the joint of the lampshade in FIG. 2.

With reference to FIGS. 1–3, a lampshade in accordance with the invention has an upper ring (10), a lower ring (11), three shades (20) and three junction tubes (30). The upper ring (10) and the lower ring (11) are parallel to each other.

The lower ring (11) is circular and has a center (not numbered), three linkages (12) and a hub (13). The three linkages (12) respectively have inner ends (not numbered) and outer ends (not numbered). The inner ends are attached to and extend radially from the hub (13) at the center of the lower ring (11). The outer ends are connected to the lower ring (11).

Each shade (20) has a resilient sheet (not numbered) and two mounting rods (21) and are bent and mounted outside the upper ring (10) and the lower ring (11). The resilient sheet is rectangular and has two vertical edges (not numbered). The two mounting rods (21) are attached respectively to the vertical edges and have an upper end (not numbered) and a lower end (not numbered). Each vertical edge has an upper corner (not numbered), a lower corner (not numbered), an upper notch (22) and a lower notch (23). The upper notch is defined at the upper corner to expose the upper end of the mounting rod (21), and the lower notch (23) is defined at the lower corner to expose the lower end of the mounting rod (21).

The three junction tubes (30) are mounted between the upper ring (10) and the lower ring (11). Each of the tubes (30) has an outer periphery (not numbered), an upper end (not numbered), a lower end (not numbered), an axial channel (31), an upper slot (32) and a lower slot (33). The axial channel (31) is defined longitudinally through the outer periphery so two mounting rods (21) from adjacent shades (20) can be mounted in the corresponding tube (30) through the channel (31). An upper slot (32) and a lower slot (33) are defined transversally in each tube (30) diametrically opposite from the channel (31). The upper ring (10) and the lower ring (11) are mounted respectively in the upper slots (32) and the lower slots (33). The rods (21) are mounted respectively between the upper ring (10) and the upper slots (32) and between the lower ring (11) and the respective lower slots (33) to hold the upper and lower rings (10, 11) in the junction tubes (30).

Each junction tube (30) has two fasteners (40) mounted respectively at the upper and lower end, and each fastener (40) has two elastic members (41) to abut the corresponding rods (21) to prevent the rods (21) from moving longitudinally in the tubes (30).

Figure 4:
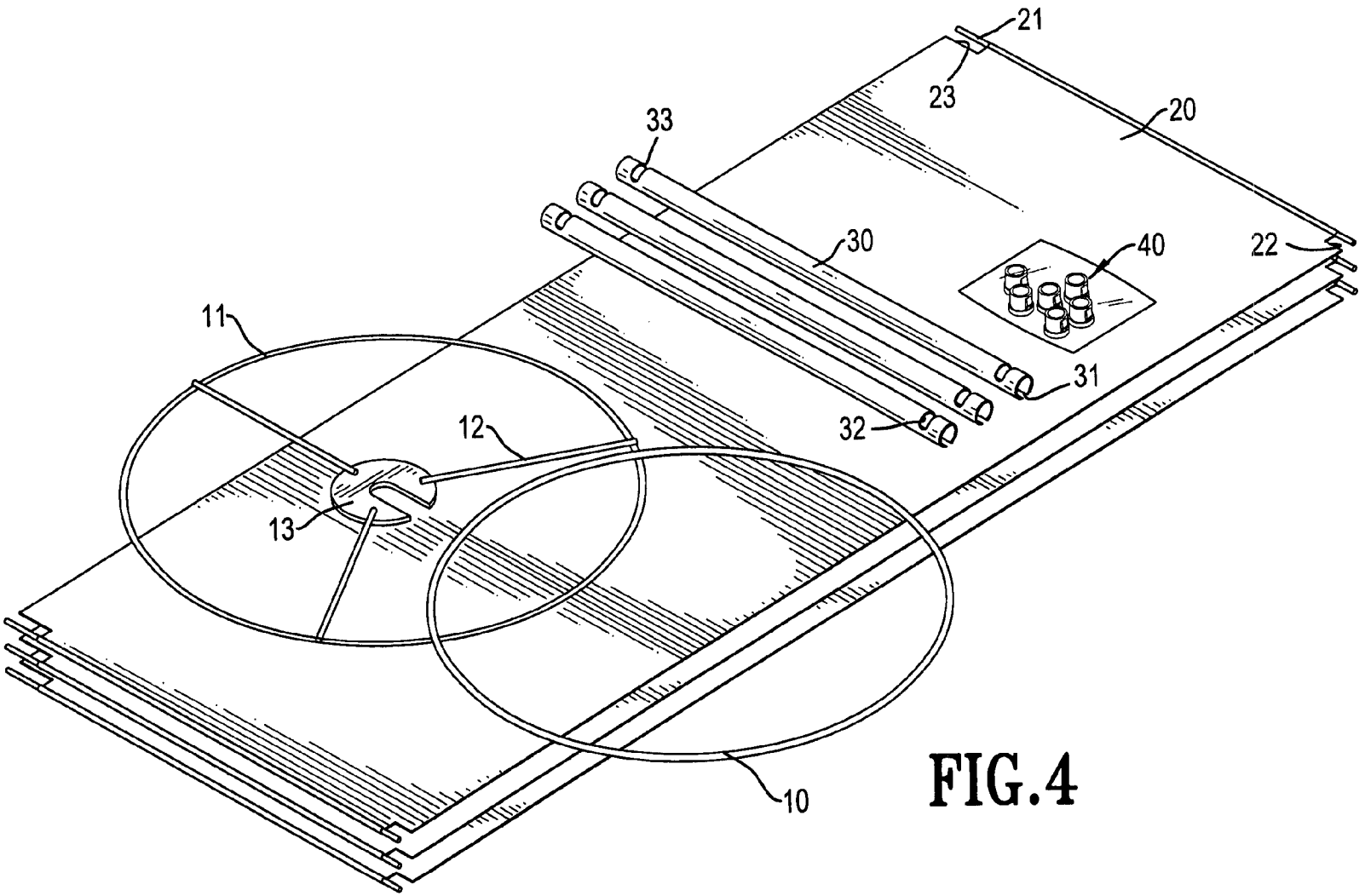
FIG. 4 is a perspective view of the lampshade in FIG. 1 disassembled.

With reference to FIG. 4, the lampshade can be completely disassembled and packaged for storage or transportation. The shades (20) are spread out and stacked together, and the rings (10, 11), the tubes (30) and the fasteners (40) are placed on the shades (20). Thus, the size of the lampshade is effectively reduced, which is very convenient for storage and transportation.

With reference to FIGS. 1–3, the lampshade is reassembled by first mounting the rods (21) from adjacent shades (20) in one of the junction tubes (30) through the channel (31) and moving the rods (21) upward above the lower slot (33). The lower ring (11) is mounted in the lower slot (33), and then the rods (21) are moved downward between the lower ring (11) and the lower slot (33). Then the rods (21) are further moved downward below the upper slots (32). The upper ring (10) is mounted in the upper slot (32), and then the rods (21) are moved upward between the upper ring (10) and the upper slot (32). Then the fasteners (40) are inserted into the tube (30) to prevent the rods (21) from moving. Repeating the processing as described above, the shades (20) can be installed outside the upper and lower rings (10, 11) to form a lampshade shaped as a flower.

The hub (13) of the lampshade can be supported by a seat (51) and provided with a bulb (50) to construct a lamp.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A detachable lampshade comprising:

an upper ring;

a lower ring parallel to the upper ring, the lower ring having a center, a hub at the center of the lower ring and a plurality of linkages extending from the hub and connected with the lower ring;

a plurality of shades, made up of an elastic material, bent to protrude outside the upper ring and the lower ring, each shade having two rods each of which is respectively provided at a side of the shade; and multiple junction tubes mounted between the upper ring and the lower ring, each tube having a channel longitudinally defined through an outer periphery of the tube, an upper slot and a lower slot transversally defined diametrically opposite the channel for respectively locating the upper ring and the lower ring, the rods being received in the respective tubes through the channels and positioned between the upper ring and the respective upper slots, and between the lower ring and the respective lower slots.

2. The detachable lampshade as claimed in claim 1, wherein each of the shades has two upper notches respectively defined at two upper corners adjacent to the rods, and two lower notches respectively defined at two lower corners adjacent to the rods.

3. The detachable lampshade as claimed in claim 1, wherein each of the tubes has two fasteners provided at two ends thereof.

4. The detachable lampshade as claimed in claim 3, wherein each of the fasteners has two elastic members to abut the respective rods for preventing the rods from moving longitudinally in the tubes.

* * * * *